US008111202B2

(12) United States Patent
Kagaya et al.

(10) Patent No.: US 8,111,202 B2
(45) Date of Patent: Feb. 7, 2012

(54) HIGH FREQUENCY WAVE GLASS ANTENNA FOR AN AUTOMOBILE AND WINDOW GLASS SHEET FOR AN AUTOMOBILE WITH THE SAME

(75) Inventors: Osamu Kagaya, Tokyo (JP); Kotaro Suenaga, Tokyo (JP); Koji Ikawa, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 360 days.

(21) Appl. No.: 12/413,709

(22) Filed: Mar. 30, 2009

(65) Prior Publication Data

US 2009/0243946 A1 Oct. 1, 2009

(30) Foreign Application Priority Data

Mar. 31, 2008 (JP) ..... 2008-093467

(51) Int. Cl.
*H01Q 1/32* (2006.01)

(52) U.S. Cl. ..... 343/713; 343/741; 343/866

(58) Field of Classification Search ..... 343/711, 343/713, 741, 744, 866
See application file for complete search history.

(56) References Cited

U.S. PATENT DOCUMENTS

| | | | | |
|---|---|---|---|---|
| 7,420,517 | B2 | 9/2008 | Oshima et al. | |
| 7,623,080 | B2 * | 11/2009 | Ogino et al. | 343/713 |
| 2007/0200708 | A1 | 8/2007 | Hayama et al. | |
| 2008/0246673 | A1 | 10/2008 | Kagaya et al. | |

FOREIGN PATENT DOCUMENTS

| | | |
|---|---|---|
| JP | 2004-112044 | 4/2004 |
| JP | 2006-270602 | 10/2006 |
| JP | 2007-67884 | 3/2007 |
| JP | 2008-278481 | 11/2008 |

* cited by examiner

*Primary Examiner* — Hoang V Nguyen
(74) *Attorney, Agent, or Firm* — Oblon, Spivak, McClelland, Maier & Neustadt, L.L.P.

(57) ABSTRACT

A high frequency wave glass antenna for an automobile includes an antenna conductor formed in a loop shape and disposed in or an automobile window glass sheet, the antenna conductor having a discontinuity and feeding portions at both ends of the discontinuity or in the vicinity of said both ends, the discontinuity being formed of a portion of the loop shape cut by a length. The antenna conductor includes a detour in a portion of the loop shape, the detour being formed of a single or a plurality of detour elements, the detour being disposed in a position, which satisfies that a rate of a distance from a center of the discontinuity of the original loop shape to a center of the detour of the original loop shape with respect to a length of an inner peripheral edge or an outer peripheral edge of the original loop shape ranges from 0.18 to 0.4.

27 Claims, 12 Drawing Sheets

HIGH FREQUENCY WAVE GLASS ANTENNA FOR AN AUTOMOBILE AND WINDOW GLASS SHEET FOR AN AUTOMOBILE WITH THE SAME

The present invention relates to a high frequency wave glass antenna for an automobile, which includes a loop-shaped antenna conductor. The present invention also relates to a window glass sheet for an automobile, which includes a loop-shaped antenna conductor.

As antennas for cell phones, there have been known loop antennas, which have a loop-shaped radiating conductor partly formed in a meandering shape (see, e.g. JP-A-2004-112044). The prior art disclosed in JP-A-2004-112044 aims at reducing the size of a loop antenna by including a portion formed in a meandering shape.

As antennas for vehicles, there have been known loop antennas, which include a loop-shaped element disposed on a dielectric portion of a vehicle (see, e.g. JP-A-2006-270602). The prior art disclosed in JP-A-2006-270602 aims at improving the directivity of a loop antenna by disposing a parasitic element in the vicinity of a loop-shaped element, the parasitic element comprising a conductor independent from a conductor forming the loop-shaped element.

There has also been known an antenna, which comprises a loop antenna having an electrical length of one wavelength of a first frequency, and a linear parasitic element having an electrical length of one-half wavelength of a second frequency different from the first frequency, extending along the loop antenna and being astride two feeding connection terminals of the loop antenna (see, e.g. JP-A-2007-67884). The prior art disclosed in JP-A-2007-67884 aims at providing the antenna with a wider bandwidth.

In the case of automobiles including a window glass sheet having a limited area for disposing a glass antenna, it is highly required to reduce the size of the antenna while it is required to have a reception performance in a wide bandwidth for receiving terrestrial digital broadcast waves. It has been difficult for the conventional high frequency wave glass antennas for automobiles to have a sufficient reception performance for receiving terrestrial digital broadcast waves.

It has been necessary to change antenna patterns according to different types of automobiles, such as feeding a glass antenna at a roof-side position of a window aperture area, and feeding a glass antenna at a pillar-side position of a window aperture area.

It is an object of the present invention to provide a small size of high frequency wave glass antenna for an automobile and a window glass sheet for an automobile, which have an antenna characteristic in a wide bandwidth and are suited to receive terrestrial digital broadcast waves.

In order to attain the above-mentioned object, the present invention provides a high frequency wave glass antenna for an automobile, which includes an antenna conductor having a discontinuity, the antenna conductor being adapted to be disposed in or on an automobile window glass sheet and having feeding portions at both ends of the discontinuity or in the vicinity of said both ends, the discontinuity being formed of a portion of an original loop shape cut by a length; the antenna conductor having a detour in a portion of the original loop shape, the detour comprising a single or a plurality of detour elements, the detour being disposed in a position, which satisfies that a rate of a distance from a center of the discontinuity of the original loop shape to a center of the detour of the original loop shape with respect to a length of an inner peripheral edge or an outer peripheral edge of the original loop shape ranges from 0.18 to 0.4.

The window glass sheet for an automobile according to the present invention is characterized to have the above-mentioned antenna conductor disposed therein or thereon.

In accordance with the high frequency wave glass antenna of the present invention, it is possible to receive a desired broadcast frequency band with a high antenna gain even if the broadcast frequency band is in a wide bandwidth of broadcast frequency band, such as a digital terrestrial television broadcast in Japan, a UHF band analog television broadcast in Japan, or a US digital television broadcast. The high frequency wave glass antenna according to the present invention is particularly suited to receive horizontally polarized waves in the broadcast band for digital terrestrial television broadcasts in Japan.

The high frequency wave glass antenna according to the present invention can be disposed in or on a window glass sheet without hindering the sight therethrough or spoiling the appearance because of being small. The high frequency wave glass antenna according to the present invention is versatile since the antenna can be easily designed so as to comply with different types of automobiles irrespective of a change in the position where the antenna is fed and since the antenna can be disposed at any one of a windshield, a door window glass, a side window glass and a backlite because of having a limited installation area.

The present invention is further described hereinafter with reference to its preferred embodiments shown in the accompanying drawings, in which.

Figure 1:
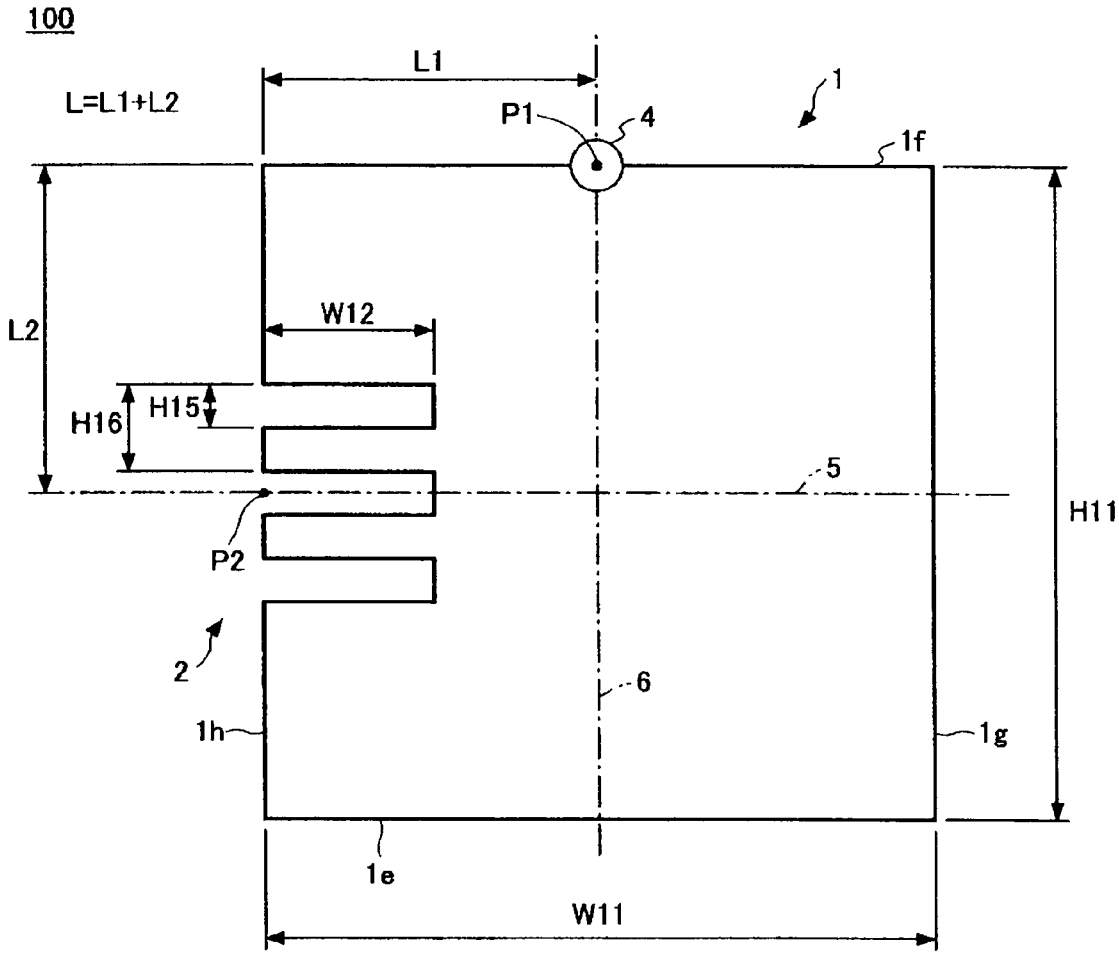
FIG. 1 is a plan view of the high frequency wave glass antenna for an automobile according to an embodiment of the present invention.

Now, the present invention will be described in detail, referring to preferred embodiments shown in the accompanying drawings. FIG. 1 is a plan view of the high frequency wave glass antenna for an automobile 100 according to an embodiment of the present invention. In the explanation of FIG. 1 and the views showing the embodiments stated later, the directions are referred to, based on the directions on the accompanying drawings, unless otherwise specified. Each of FIG. 1, and FIGS. 2 to 5 and FIG. 12 stated later is a view seen from a car-interior side or a car-exterior-side of the window glass sheet. In the following explanation, the embodiments will be described about a case where the antenna is suited for a digital terrestrial television broadcast in Japan, unless otherwise specified. With respect to the explanation of the shape of the antenna conductor, the shape that would be formed by an antenna conductor including a detour and a discontinuity formed by partly cutting a loop-shaped conductor when it is assumed that no discontinuity is formed and that both ends of the detour are connected, in other words, no detour is disposed in the antenna conductor will be called an "original loop shape". For the sake of simplicity, the phrase of "loop-shaped antenna" is used instead of the phrase of "antenna conductor formed in an original loop shape" in some cases.

In the glass antenna 100 according to the embodiment shown in FIG. 1, reference 1 designates an antenna conductor, reference 1*f* designates an upper side of a loop-shaped conductor, reference 1*e* designates a lower side of the loop-shaped conductor, reference 1*h* designates a left side of the loop-shape conductor, reference 1*g* designates a right side of the loop-shape conductor, reference 2 designates a detour, and reference 4 designates a feeding section. The glass antenna has a discontinuity formed by partly cutting the loop-shaped conductor by a certain length at the feeding section, although the discontinuity is not shown in FIG. 1.

In the antenna conductor 1, the detour 2, which is formed of a plurality of detour elements, is disposed in a portion of the original loop shape. The detour 2 shown in FIG. 1 is disposed in the left side 1*h* and is formed in a meandering shape with three angulated U-character shape of detour elements. The antenna conductor 1 according to the present invention has an improved antenna gain since the detour 2 is disposed in a position, which satisfies that the rate of the distance from a center P1 of the discontinuity of the feeding portion 4 to a center P2 of the detour 2 with respect to the length of an inner peripheral edge or an outer peripheral edge of the loop-shaped conductor (the peripheral length of an inner edge or an outer edge of the original loop shape of the loop-shaped conductor that is obtained when it is assumed that no detour 2 is disposed) ranges from 0.18 to 0.4 wherein the center P1 is located on the assumed original loop shape and wherein the center P2 is located on the original loop shape that is obtained when it is assumed that no detour 2 is disposed.

In the embodiment shown in FIG. 1, the antenna conductor 1 is formed in a square shape, and the upper side 1*f* and the lower side 1*e* are disposed so as to extend horizontally. When it is assumed that there is an imaginary transverse plane 5 which passes through the center of gravity of the original loop shape and is perpendicular to a glass sheet having the antenna conductor 1 therein or thereon and extending parallel to the lower side 1*e*, and when it is assumed that there is an imaginary perpendicular plane 6 which passes through the center of gravity of the original loop shape and is perpendicular to the imaginary transverse plane 5, the feeding section 4 (the center P1 of the discontinuity) is located at a position where the upper side 1*f* of the original loop shape intersects the imaginary perpendicular plane 6. In other words, the feeding section 4 is located at the midpoint of the upper side 1*f*. The center P2 of the detour 2 is located at a position where the left side 1*h* of the original loop shape intersects the imaginary transverse plane 5. In other words, the center P2 of the detour 2 is located at the midpoint of the left side 1*h*. When the center P1 of the discontinuity and the center P2 of the detour 2 have a distance of L therebetween, when each of the upper side 1*f* and the lower side 1*e* has a width of W11, and when each of the left side 1*h* and the right side 1*g* has a height of H11, the rate of the distance from the center P1 of the discontinuity to the center P2 of the detour 2 with respect to the inner peripheral length of the original loop shape is represented by L/2 (W11+H11). In FIG. 1, when the distance from the center P1 of the discontinuity to a point where the upper side 1*f* and the left side 1*h* intersect each other is represented by L1, and when the distance from the center P2 of the detour 2 to a point where the upper side 1*f* and the left side 1*h* intersect each other is represented by L2, the formulas of L=L1+L2=W11=H11 and L/2(W11+H11)=0.25 are established.

Figure 2:
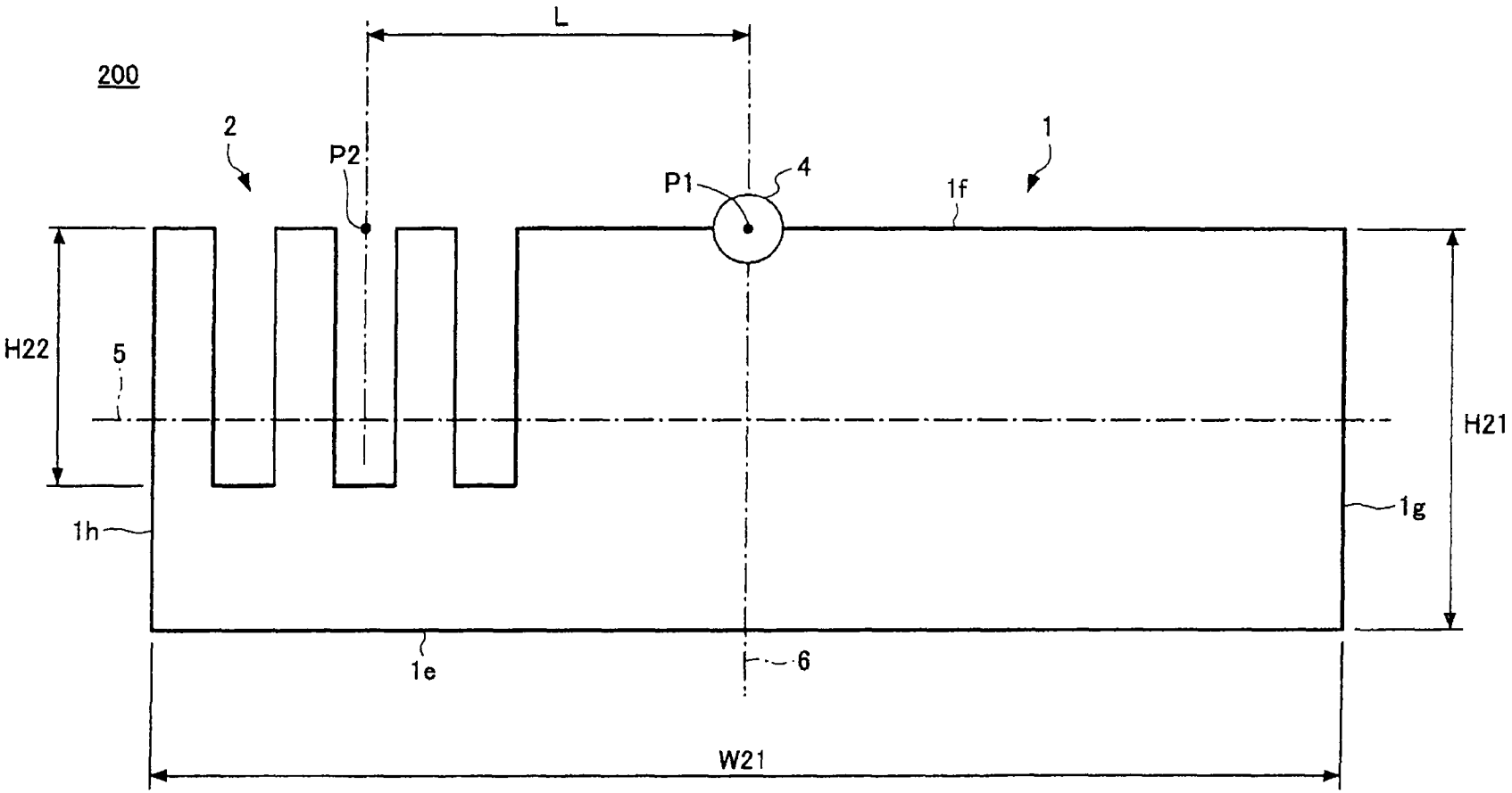
FIG. 2 is a plan view of the high frequency wave glass antenna for another automobile according to another embodiment of the present invention.

In the glass antenna 200 shown in FIG. 2, the loop shape of the antenna conductor 1 is formed in a rectangular shape. In order that the glass antenna according to the present invention is configured to be easily mounted as a high frequency wave glass antenna for an automobile, it is preferred that the loop-shaped conductor be formed in a rectangular shape, a substantially rectangular shape, a parallelogram shape having long sides and short sides, a substantially parallelogram shape having long sides and short sides, a trapezoidal shape or a substantially trapezoidal shape.

In the present invention, when the loop-shaped conductor is formed in a quadrangular shape or a substantially quadrangular shape except for a rectangular shape, it is preferred in terms of improved antenna gain and ease in mounting that each of the four interior angles be set at 70 to 110 degrees, in particular 80 to 100 degrees.

When loop-shaped conductor is formed in a rectangular shape, a substantially rectangular shape, a parallelogram shape having long sides and short sides, a substantially parallelogram shape having long sides and short sides, a trapezoidal shape or a substantially trapezoidal shape, it is preferred that the antenna conductor be disposed in or on a glass sheet so that the absolute value of a smaller one of the angles included between a longitudinal direction of an inner peripheral edge of the longest side of the four sides of the loop shape (an arbitrary side in the case of a square shape) and a horizontal plane is set at 0 to 30 degrees. When the absolute value is within this range, it is possible to provide the antenna with an improved antenna gain in comparison with a case where the absolute value is outside of this range. Since digital terrestrial television broadcast waves are mainly formed of horizontally polarized waves, it is preferred in terms of improved antenna gain that the absolute value be set at a value within this range. This range is preferably 0 to 15 degrees.

In the embodiment shown in FIG. 2, it is preferred that the antenna conductor be disposed in or on a glass sheet so that the absolute value of a smaller one of the angles included between the lower side and the horizontal plane is set at 0 to 30 degrees.

In the present invention, it is preferred that the detour 2 be disposed in any one of the four sides of the loop-shaped conductor. In the embodiment shown in FIG. 2, the detour 2 is disposed in the upper side 1*f* of the loop-shaped conductor. In this case, it is preferred that the discontinuity (not shown) of the feeding section 4 be disposed in the same side as the detour. In the embodiment shown in FIG. 2, the discontinuity is disposed in the upper side 1*f* as in the detour. When the detour and the feeding section are disposed in the same side as each other, it is possible to provide the antenna with an improved antenna gain and a wider bandwidth in comparison with a case where the detour and the feeding section are disposed in different sides.

In the embodiment shown in FIG. 2, the center P1 of the discontinuity of the feeding section 4 is located at a position where the upper side 1*f* of the original loop shape intersects the imaginary perpendicular plane 6. The detour 2 is located in the vicinity of a left edge of the upper side 1*f* so as to be disposed in the upper side 1*f* as in the feeding section 4 and is formed in a meandering shape with three angulated U-character shape of detour elements. When the center P1 of the discontinuity and the center P2 of the detour 2 have a distance of L therebetween, when each of the upper side 1*f* and the lower side 1*e* has a width of W21, and when each of the left side 1*h* and the right side 1*g* have a height of H21, the detour 2 is disposed in a position, which satisfies that the rate of the distance from the center P1 of the discontinuity to the center P2 of the detour 2 with respect to the length of the inner peripheral edge the original loop-shaped conductor L/2(W21+H21) ranges from 0.18 to 0.4.

Figure 3:
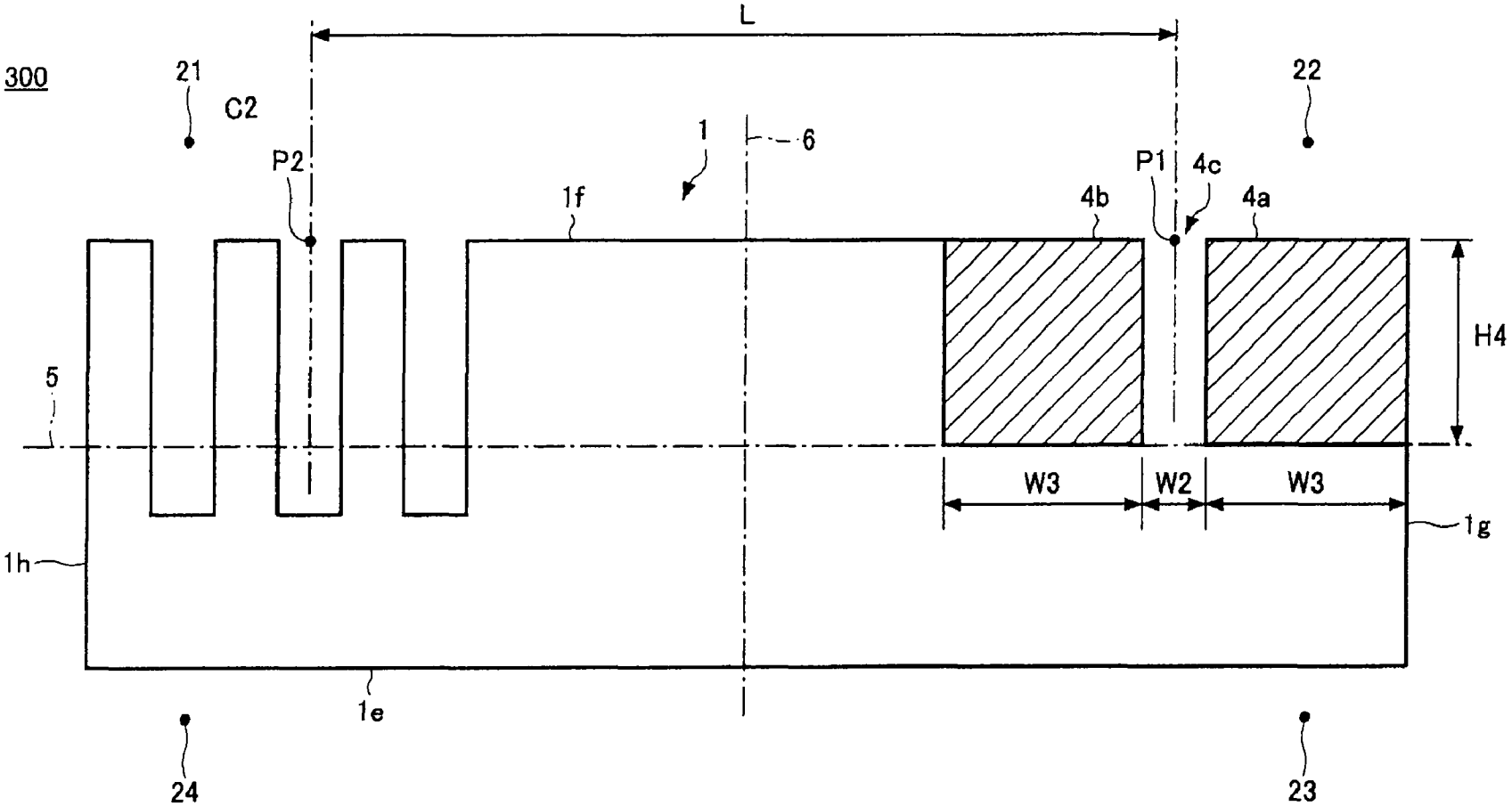
FIG. 3 is a plan view of the high frequency wave glass antenna for another automobile according to another embodiment of the present invention.

The glass antenna 300 according to the embodiment shown in FIG. 3 has the same shape as the glass antenna shown in FIG. 2 except for the shape of the feeding section 4 shown in FIG. 2. In FIG. 3, the antenna includes a feeding section 4 formed of a discontinuity 4*c* in the vicinity of a right end of the upper side 1*f*, the discontinuity being formed by cutting the upper side 1*f*, the feeding section being formed of feeding portions 4*a* and 4*b* disposed at both ends of the discontinuity 4. The discontinuity 4*c* is located between the feeding portion 4*a* disposed at an upper end of the right side 1*g* and the feeding portion 4*b* disposed at a position close to the center of the upper side 1*f*. The feeding portions 4*a* and 4*b* have a greater width than the conductor width of the other sides of the antenna conductor. It is preferred in terms of excellent impedance matching and reduction in reflection loss that the feeding portions have a greater width.

In the present invention, when the loop-shaped conductor is formed in a rectangular shape, it is preferred that the detour be disposed at or in the vicinity of one end of a long side of the rectangular shape and that the feeding portions be disposed at or in the vicinity of the other end of the long side. In the embodiment shown in FIG. 3, the detour 2 is disposed in the vicinity of a left edge of the upper side 1*f*, and the feeding portions 4*a* and 4*b* are disposed in the vicinity of the right edge of the upper side 1*f*.

In the embodiment shown in FIG. 3, it is assumed that there is an imaginary transverse plane 5 which passes through the center of gravity of the loop-shaped conductor and is perpendicular to a glass sheet having the antenna conductor 1 therein or thereon and extending parallel to the lower side 1*e* of the loop-shaped conductor 1, and that there is an imaginary perpendicular plane 6 which passes through the center of gravity and is perpendicular to the imaginary transverse plane 5. Both of the imaginary transverse plane 5 and the imaginary perpendicular plane 6 extend from in front of the front side of the drawing sheet showing FIG. 3 toward behind the back side of the drawing sheet and are perpendicular to the drawing sheet.

In this embodiment, when it is assumed that the antenna conductor 1 is divided into four regions by the imaginary transverse plane 5 and the imaginary perpendicular plane 6, that an upper region on an opposite side of the discontinuity 4*c* is called a first region 21, that an upper region on the same side as the discontinuity 4*c* is called a second region 22, that a lower region on the same side as the discontinuity 4*c* is called a third region 23, and that a lower region on the opposite side of the discontinuity 4*c* is called a fourth region 24, it is preferred that the detour 2 be disposed in the first region 21.

Figure 4:
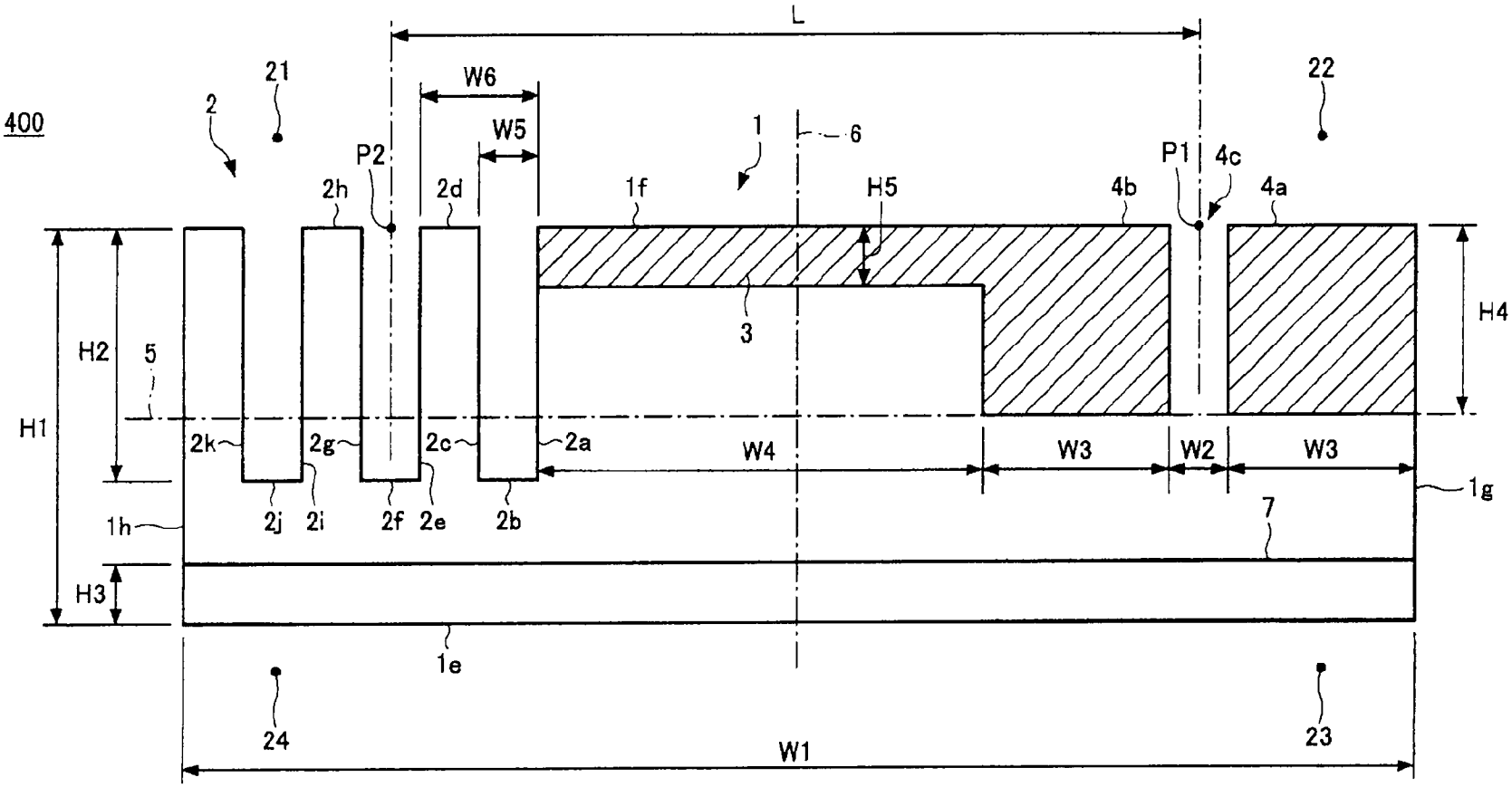
FIG. 4 is a plan view of the high frequency wave glass antenna for another automobile according to another embodiment of the present invention.

The glass antenna 400 according to the embodiment shown in FIG. 4 has the same shape as the glass antenna shown in FIG. 3 except for the shape of the upper side 1*f* and the lower side 1*e* shown in FIG. 3. In FIG. 4, the glass antenna has an upper side 1*f* forming a wide conductor part 3 and a lower side 1*e* having an auxiliary conductor 7.

In the present invention, when the loop shape of the antenna conductor is a rectangular shape, it is preferred that at least 70% of the entire length of at least one of the longer sides of the rectangular shape have a width of 2 to 20 mm, provided that if the detour is disposed in a portion of the longer side, said width is not applied to such a portion of the at least one long side with the detour. In the embodiment shown in FIG. 4, a portion of the upper side 1*f* sandwiched between the feeding portion 4*b* and the detour 2 is configured to have a width H5 set at a greater value than the conductor width of the other sides of the antenna conductor.

In the present invention, when the loop-shaped conductor is formed in a rectangular shape, at least one of the longer sides of the rectangular shape may have at least one linear auxiliary conductor in parallel or in substantially parallel therewith a distance of 2 to 20 mm therefrom, provided that if the detour is disposed in a portion of the at least one longer side, the distance is not applied to such a portion of the at least one longer side with the detour. In FIG. 4, the auxiliary conductor 7 is disposed in parallel with the lower side 1*e* so as to be apart from the lower side by a distance of H3.

The dimensions of the respective parts of a glass antenna shown as an example in FIG. 4 are shown below. The unit of the lengths is mm.

| | | | | | |
|---|---|---|---|---|---|
| H1: 40 | H2: 22.5 | H3: 5 | H4: 20 | H5: 5 | |
| W1: 150 | W2: 5 | W3: 20 | W4: 75 | W5: 5 | W6: 10 |

Conductor width of antenna conductor 1: 0.8

In a case where the loop-shaped conductor is formed in a rectangular shape in the present invention, when the center frequency of a desired broadcasting frequency band has a wavelength of $\lambda_0$ in air, when glass has a shortening coefficient of wavelength of k, when the formula of k=0.64 is established, and when the formula of $\lambda_g=\lambda_0 \cdot k$ is established, it is preferred in terms of improved antenna gain and ease in mounting that the long side of the original loop shape have an inner peripheral length of $0.36 \cdot \lambda_g$ to $0.60 \cdot \lambda_g$. It should be noted that the center frequency of the digital terrestrial television broadcasting band (470 to 600 MHz) is 620 MHz, and that the value of $\lambda_g$ in 620 MHz is 309.7 mm. When the range of 470 to 600 MHz currently used in the digital terrestrial television broadcasting band is set as a reception frequency band, the center frequency is 535 MHz. When the range of 470 to 710 MHz in the digital terrestrial television broadcasting band is set as a reception frequency band, the center frequency is 590 MHz. In consideration of these factors, specifically, it is preferred in terms of improved antenna gain that the long side of the original loop shape formed in a rectangular shape have an inner peripheral length of 90 to 245 mm, in particular 120 to 180 mm. In the glass antenna shown as an example in FIG. 4, the inner peripheral length is 150 mm.

When a radio wave for communication has a wavelength of $\lambda_0$ in air, when glass has a shortening coefficient of wavelength of k, and when the formula of $\lambda_g=\lambda_0 \cdot k$ is established, it is preferred in terms of improved antenna gain that the antenna conductor have an inner peripheral length of $0.79\lambda_g$ to $2.50\lambda_g$, the inner peripheral length containing the detour elements and the discontinuity of the original loop shape. With regard to the phrase of "the inner peripheral length containing the detour elements and the discontinuity of the original loop shape", the inner peripheral length means the length of the entire inner peripheral edge of the antenna conductor that is obtained when it is assumed that no discontinuity 4 is disposed (that is continuous so as to form the original loop shape without a discontinuity), and contains the length of the discontinuity along the original loop shape and the length of a portion of the conductor serving as the detour elements. When the antenna conductor includes a wide portion, such as the wide part 3, an auxiliary conductor, such as the element 7, or feeding portions, such as the elements 4*a* and 4*b*, the length of the inner peripheral edge of the wide portion and the length of the inner peripheral edge of the auxiliary conductor are contained in "the inner peripheral length".

In consideration of the center frequency of the digital terrestrial television broadcasting band, specifically, it is preferred that the inner peripheral edge containing the detour and the discontinuity of the original loop shape have a length of 197 to 1,021 mm, in particular 300 to 650 mm.

It is preferred in terms of improved antenna gain that the relationship between a maximum vertical width H and a maximum transverse width W of the shape formed by the inner peripheral edge of the antenna conductor satisfy the formula of (W/H=1 to 9). For example, in a case where the loop-shaped conductor is formed in a rectangular shape, when the detour is disposed within the rectangular shape, the maximum vertical width H and the maximum transverse width W respectively correspond to the lengths of a long side and a short side of the maximum outer dimensions of the rectangular shape, and when the detour is disposed outside of the rectangular shape, the maximum vertical width H and the maximum transverse width W respectively correspond to the maximum outer dimensions of the rectangular shape containing the detour disposed outside of the rectangular shape. In the embodiment shown in FIG. 1, the maximum vertical width H corresponds to H11, and the maximum transverse width W corresponds to W11. In the embodiment shown in FIG. 4, the formula W/H=3.75 is established.

It is preferred that the discontinuity have a shortest spacing of 0.5 to 20 mm, in particular 1 to 10 mm. When the discontinuity has a shortest spacing of 0.5 mm or more, it is easier to fabricate the antenna in comparison with a case where the discontinuity has a shortest spacing of less than 0.5 mm. When the discontinuity has a shortest spacing of less than 20 mm, it is easier to obtain an improved antenna gain in comparison with a case where the discontinuity has a shortest spacing of greater than 20 mm. In the embodiment shown in FIG. 4, the discontinuity 4*c* is set to have a spacing W2 of 5 mm.

The detour may be formed of a single detour element or a plurality of detour elements. The detour elements have a maximum spacing of preferably 2.5 to 7.5 mm (more preferably 3.5 to 6.5 mm) in a direction along the original loop shape. The detour elements have a maximum distance of preferably 11 to 33 mm (more preferably 15.4 to 28.6 mm) remote from the original loop shape. When the detour is formed of a plurality of detour elements, the detour is preferably disposed to have a spacing of 2.5 to 7.5 mm between adjacent detour elements. It is preferred in terms of improved antenna gain that the number of the detour elements is 2 to 8. In the embodiment shown in FIG. 4, the detour elements are set to have a maximum spacing (a spacing) W5 set at 5 mm and to have a maximum distance H2 set at 22.5 mm. With respect to the number of the detour elements, when it is defined that elements 2*a*, 2*b* and 2*c* form a single detour element, that elements 2*e*, 2*f* and 2*g* form a single detour element, and that elements 2*i*, 2*j* and 2*k* form a single detour element, it is meant that three detour elements are disposed. The spacing of the detour elements in the embodiment shown in FIG. 4 corresponds to each of the spacing between the elements 2*c* and 2*e* and the spacing between the elements 2*g* and 2*i*.

The detour of the embodiment shown in FIG. 4 is formed in a meandering shape with angulated U-character shape of detour elements. However, the detour may be formed in a different shape. The detour elements may be formed in a U-character shape, a substantially U-character shape, a V-character shape, a substantially V-character shape, a semicircular shape or a substantially semicircular shape. Such a U-character shape, a V-character shape and a semicircular shape may be directed in any direction. In other words, in the case of, e.g. a meandering shape with angulated U-character shape of detour elements, the detour element does not necessarily need to horizontally project toward a right direction. The detour element may horizontally project toward a left direction, an upward direction or a downward direction. The projecting direction does not matter.

In the embodiment shown in FIG. 4, the detour is disposed to extend inwardly from the loop-shape conductor, which is preferred in terms of reduction in size. However, the detour does not necessarily need to extend inwardly from the loop-shape conductor. The detour may be disposed to extend outside of the loop-shape conductor. The detour may be formed in such a shape to have an effect similar to a reactance circuit. In other words, it is preferred in terms of excellent impedance matching and reduction in reflection loss that the detour be formed in such a shape to serve as a reactance circuit.

Figure 5:
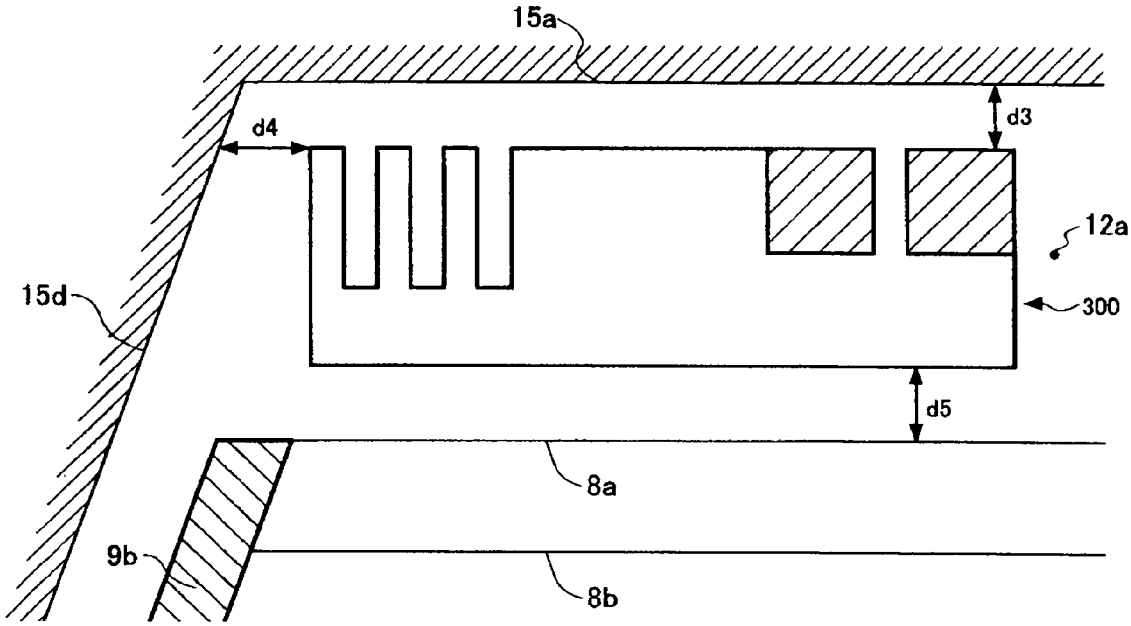
FIG. 5 is a schematic view showing how to provide the rear window glass of an actual automobile with the antenna conductor shown in FIG. 3.

FIG. 5 is a plan view (seen from a car-interior side or a car-exterior side) showing an embodiment, wherein the antenna conductor 1 shown as an example in FIG. 3 is disposed in an upper left area of the backlite 12*a* of a vehicle. In FIG. 5, reference 15*a* designates an upper edge of the vehicle aperture area for the backlite, and reference 15*d* designates a left edge of the vehicle aperture area. The edge of the vehicle aperture area is a peripheral edge of an opening of the vehicle body, into which a window glass sheet is fitted, and which serves as vehicle grounding and is formed of a conductive material, such as metal.

When the antenna conductor is disposed in an upper area of a window glass sheet, and when the maximum distance W1 between an upper edge 15*a* of a vehicle aperture area for the window glass sheet and the outer edge of the entire upper side of the original loop shape confronting the upper edge of the vehicle aperture area is $0.36\lambda_g$ to $0.60\lambda_g$, it is preferred in terms of improved antenna gain that the antenna conductor be disposed so that the distance d3 between the upper edge 15*a* and the outer edge of the entire upper side of the antenna conductor is an average value of $0.032\cdot\lambda_g$ or more, in particular, $0.048\cdot\lambda_g$ or more.

When the antenna conductor is disposed in an upper area of a window glass sheet in order to receive a terrestrial digital broadcast wave, and when the maximum distance W1 between an upper edge 15*a* of a vehicle aperture area for the window glass sheet and the outer edge of the entire upper side of the original loop shape confronting the upper edge of the vehicle aperture area is 90 to 245 mm, it is preferred in terms of improved antenna gain that the antenna conductor be disposed so that the distance d3 between the upper edge 15*a* and the outer edge of the entire upper side of the antenna conductor is an average value of 10 mm or more, in particular, 15 mm or more.

It is preferred in terms of securing the sight through a window glass sheet that the shortest distance between the upper edge 15*a* and a portion of the outer peripheral edge of the antenna conductor farthest from the upper edge 15*a* be 200 mm or less, in particular, 150 mm or less.

FIG. 5 (see from a car-interior side or a car-exterior side) shows the upper left area of the rear window glass sheet 12*a* in an embodiment wherein the antenna conductor 1 is disposed in or on the rear window glass sheet 12*a*. The rear window glass sheet 12*a* includes a plurality of heating wires and a plurality of bus-bars (only a single bus-bar being shown in FIG. 5) for energizing the plurality of heating wires, and the plurality of heating wires and the plurality of bus-bars form a defogger. In FIG. 5, reference 8*a* designates the heating wire at the highest position, reference 8*b* designates the heating wire at the second highest position, reference 9*b* designates a bus-bar, and reference d5 designates the distance between the heating wire at the highest position and the entire lower side of the antenna conductor confronting the heating wire at the highest position.

The plural heating wires extend in a horizontal direction, in a substantially horizontal direction, in a direction along the upper edge of the backlite 12*a* or in a direction along the lower edge of the backlite 12*a*. The antenna conductor is disposed in an upper marginal area of the backlite 12*a* except for an area where the defogger is disposed. It is preferred in terms of improved antenna gain that the maximum distance between the heating wire at the highest position and the outer edge of the entire lower side of the original loop shape of the antenna conductor confronting the heating wire at the highest position be 0.36 $\lambda_g$ to 0.60 $\lambda_g$, and that the antenna conductor be disposed so that the distance between the heating wire at the highest position and the entire lower side of the antenna conductor confronting the heating wire at the highest position be an average value of $0.0097 \cdot \lambda_g$ or more, in particular, $0.016 \cdot \lambda_g$ or more.

In consideration of a space required for disposing the antenna conductor and reduction in the space, it is preferred that the distance between the upper edge 15*a* of a vehicle aperture area and the heating wire 8*a* at the highest position be 100 to 200 mm.

Figure 12:
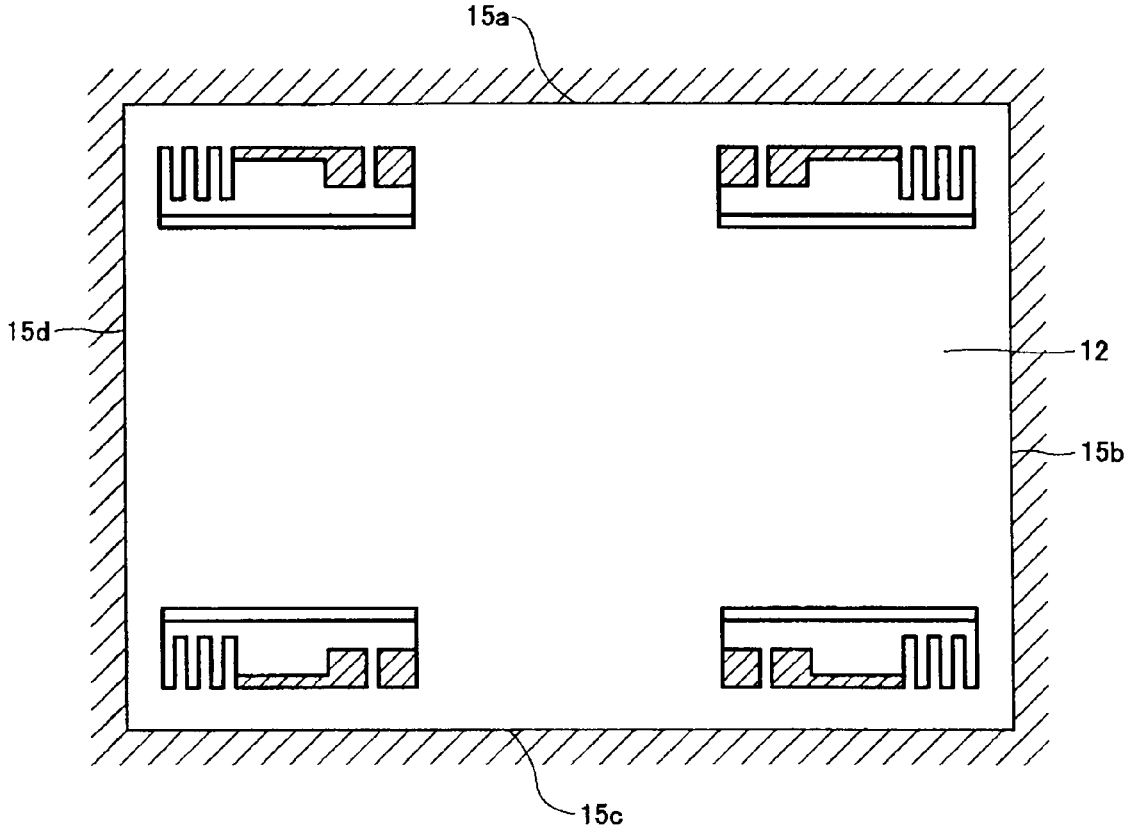
FIG. 12 is a schematic view showing an installation example of the antenna conductor according to the present invention.

FIG. 12 shows an example where the antenna conductor is disposed in or on a window glass sheet 12. The antenna conductor is formed of four antenna conductors, which are disposed in an upper left area, an upper right area, a lower left area and a lower right area of the window glass sheet 12. In the example shown in FIG. 12, when the window glass sheet 12 forms a backlite, the window glass sheet includes a defogger (not shown) in a central area of the window glass sheet. However, the four antenna conductors do not necessarily need to be disposed in the four areas of the window glass sheet. The antenna conductor may be disposed in at least one of the four areas. The antenna conductor may be disposed in a central upper area or a central lower area, not in an upper left area, an upper right area, a lower left area and a lower right area.

In the present invention, when an antenna conductor is disposed in an upper left area of the window glass sheet 12, this antenna conductor may be disposed in the same way as the antenna conductor shown in an upper right area in FIG. 12. When an antenna conductor is disposed in an upper right area of the window glass sheet 12, this antenna conductor may be disposed in the same way as the antenna conductor shown in an upper left area in FIG. 12. This is also applicable to a case where an antenna conductor is disposed in the lower right or left area. In the present invention, when the rate of the length of a portion of a loop-shaped conductor from the feeding section to the detour with respect to the entire peripheral length of the loop-shaped conductor is set 0.18 to 0.4, it is possible to obtain an improved antenna gain. Thus, the present invention can provide a versatile glass antenna, which is capable of coping with any change in the position of the feeding section according to vehicle types, irrespective of the position of the feeding section.

The provision of a plurality of antenna conductors as described above enables diversity reception, favorably obtaining an improved reception characteristic.

The antenna conductor shown in each of FIGS. 1 to 4 is not accompanied by an auxiliary antenna conductor. However, the antenna conductor according to the present invention may be accompanied by an auxiliary antenna conductor, such as an antenna conductor formed in a substantially T-character shape, an antenna conductor formed in a substantially L-character shape or a loop-shaped antenna conductor, through or without a connection conductor for the purpose of, e.g. impedance matching, phase adjustment or directional adjustment.

When a coaxial cable is used as a feeder, the center conductor and the outer conductor of the coaxial cable are connected to both ends or in the vicinity of both ends of the discontinuity 4*c*. The coaxial cable is connected to a receiver. The coaxial cable may be directly connected, by, e.g. soldering, to or indirectly connected, through a connector, to both ends or in the vicinity of both ends of the discontinuity 4*c*.

The antenna conductor may be disposed by forming a plastic film with a conductive layer disposed therein or thereon, on the car-interior side or the car-exterior side of a backlite. The antenna conductor may be disposed by forming a flexible circuit board with a conductive layer disposed therein or thereon, on the car-interior side or the car-exterior side of a backlite.

The high frequency wave glass antenna for an automobile according to the present invention may be disposed in or on any vehicle glass sheet, such as a windshield, a door glass, a side window or a backlite. There is no limitation to the window glass sheet that the glass antenna according to the present invention is disposed in or on.

It is preferred in terms of improved antenna gain that the glass antenna according to the present invention be mounted to an automobile at an angle of 18 to 90 degrees, in particular 24 to 90 degrees with respect to a horizontal direction.

The antenna conductor may be disposed by printing paste containing conductive metal, such as silver paste, on the car-interior side of a window glass sheet and baking the printed paste. However, the antenna conductor is not necessarily disposed by this forming method. The antenna conductor may be disposed by bonding a linear member or foil member on the car-interior side or the car-exterior side of a glass sheet or in a glass sheet by, e.g. an adhesive, the linear member or foil member being formed of a conductive substance, such as copper.

In the present invention, a light-shielding coat may be disposed on a window glass sheet so that the antenna conductor is partly or entirely disposed on the light-shielding coat. The shielding coat may be formed of a ceramic coat, such as a black ceramic coat. In this case, the window glass sheet has an excellent appearance since the light-shielding coat shields portions of the antenna conductor disposed on the light-shielding coat when the window glass sheet is seen from a car-exterior side. In the case of the embodiment shown in FIG. 4, the feeding section and at least a portion of the detour is preferably disposed on such a light-shielding coat in terms of appearance since only a linear thin portion of the conductor is visible from a car-exterior side.

Now, the present invention will be described in reference to Examples. It should be noted that the present invention is not limited to these Examples, and that variations or modifications are included in the present invention as long as the variations and modifications do not depart from the spirit of the present invention. The Examples will be described in detail in reference to the accompanying drawings.

EXAMPLE 1

It was assumed that a square glass substrate formed a window glass sheet. The high frequency wave glass antenna for an automobile according to the present invention was formed by disposing the antenna conductor 1 shown in FIG. 1 at a central portion of the glass substrate on a single side of the glass substrate, which was supposed to be positioned on a car-interior side. It was also assumed that there was neither car body nor defogger.

Values of VSWRs (voltage standing wave ratio) were found by performing numerical calculations by use of electromagnetic simulation based on the FDTD method (Finite-Difference Time-Domain method) for every 10 MHz in a frequency band of 400 to 700 MHz with the position of the detour 2 disposed on the square loop shaped conductor being changed. The position of the detour 2 was changed by modifying the length L (=L1+L2) from the center P1 of the discontinuity of the feeding section 4 to the center P2 (on the peripheral portion) of the detour 2. In other words, the distance from the center of the feeding section 4 and the center of the detour 2 was changed by shifting the detour 2 along the outer configuration of the loop shaped conductor. The constants, such as the thickness of the glass substrate and the dimensions of the respective parts of the planar antenna were as follows:

| | |
|---|---|
| Dimension of glass substrate | 300 × 300 mm |
| Thickness of glass substrate | 3.10 mm |
| Dielectric constant of glass substrate | 7.0 |
| H11, W11 | 72 mm |
| W12 | 38 mm |
| H15 | 5 mm |
| H16 | 10 mm |
| Conductor width of antenna conductor 1 | 0.8 mm |
| Spacing of feeding section 4 (distance between electrodes 4a and 4b) | 5 mm |
| Entire peripheral length of loop (containing detour elements) | 516 mm |

Figure 6:
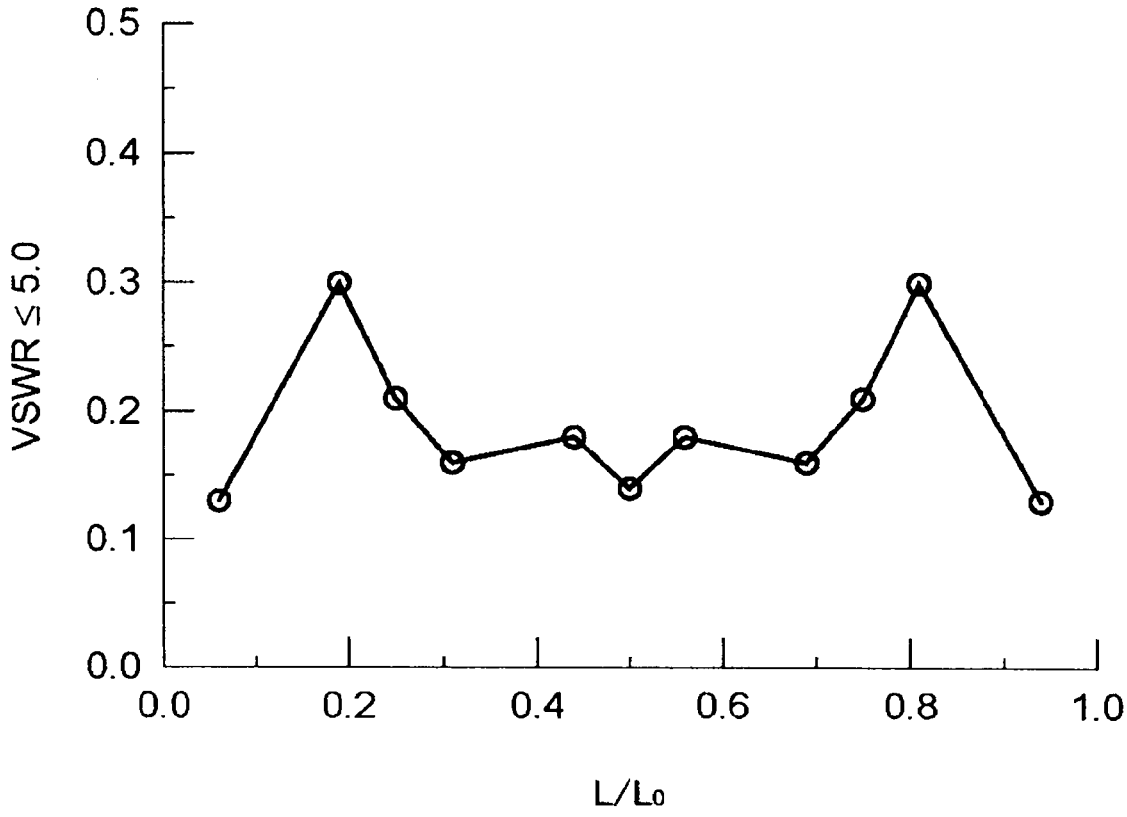
FIG. 6 is a characteristic graph of the antenna conductor shown in FIG. 1, which represents $L/L_0$ by the vertical axis and rates of VSWR≦5.0 by the horizontal axis.

FIG. 6 is a characteristic graph of the antenna conductor shown in FIG. 1, wherein the horizontal axis represents a value (=$L/L_0$) obtained by dividing the distance L from the center P1 of the discontinuity of the feeding section 4 to the center P2 of the detour 2 by the entire peripheral length $L_0$ (=2×(H11+W11)) of the loop that is obtained when it is assumed that no detour is disposed, and the vertical axis represents a rate that the formula of VSWR≦5.0 is established in a band range of 400 to 700 MHz. In this graph, the greater the rate is, the wider bandwidth the antenna is effective in.

As shown in FIG. 6, the rate that the formula of VSWR≦5.0 is established has a maximum calculated value when the detour is disposed at such a position that $L/L_0$ is 0.19 or 0.81. This means that when the detour is disposed at such a position, it is possible to obtain an excellent antenna characteristic effective in a wide bandwidth in the case of the antenna conductor being formed in the shape shown in FIG. 1.

EXAMPLE 2

The high frequency wave glass antenna for an automobile according to the present invention was formed by disposing the antenna conductor 1 shown in FIG. 2 on a glass substrate as in Example 1, and values of VSWR were found by carrying out numerical calculations in accordance electromagnetic field simulation under the same conditions as Example 1. The constants, such as the thickness of the glass substrate, and the dimensions of the respective parts of the planar antenna were as follows:

| | |
|---|---|
| H21 | 40 mm |
| W21 | 150 mm |
| H22 | 22.5 mm |
| Entire peripheral length of loop (containing detour elements) | 515 mm |

The unspecified constants were the same as Example 1.

Figure 7:
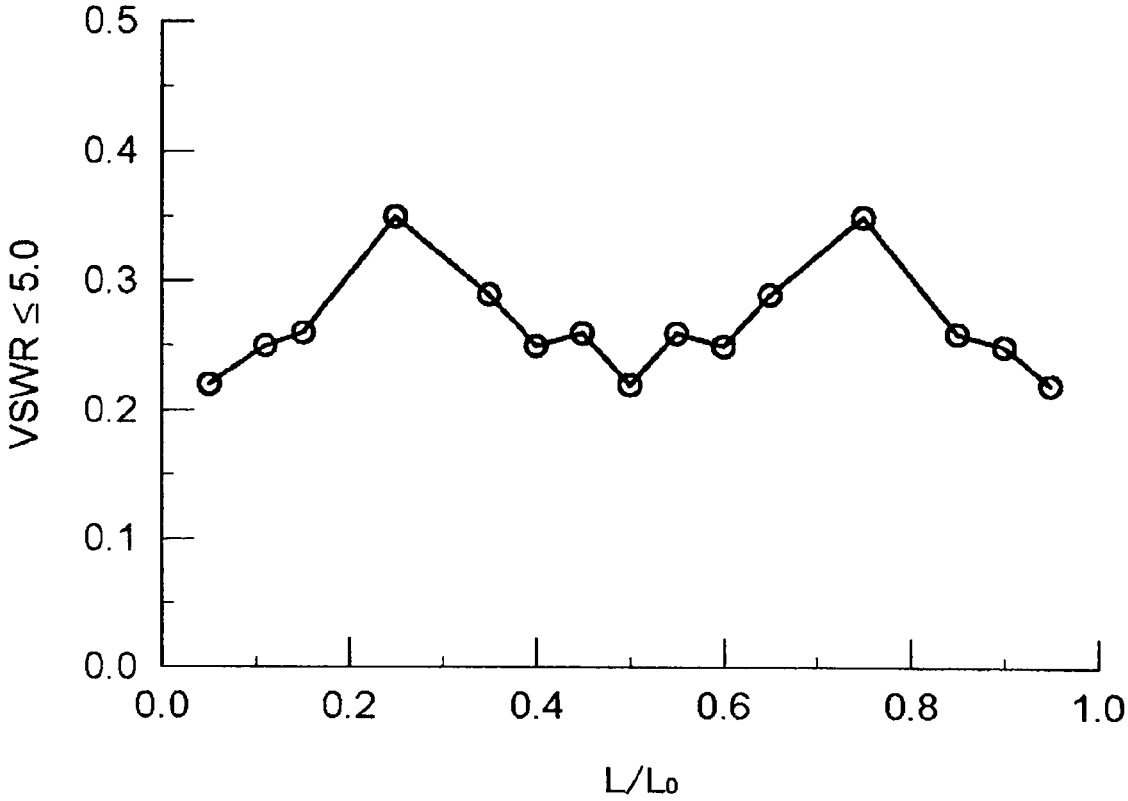
FIG. 7 is a characteristic graph of the antenna conductor shown in FIG. 2, which represents $L/L_0$ by the vertical axis and rates of VSWR≦5.0 by the horizontal axis.

FIG. 7 is a characteristic graph of the antenna conductor shown in FIG. 2, wherein the horizontal axis represents a value (=$L/L_0$) obtained by dividing the distance L from the center P1 of the discontinuity of the feeding section 4 to the center P2 of the detour 2 by the entire peripheral length $L_0$ (=2×(H21+W21)) of the loop that is obtained when it is assumed that no detour is disposed, and the vertical axis represents a rate that the formula of VSWR≦5.0 is established in a band range of 400 to 700 MHz.

As shown in FIG. 7, the rate that the formula of VSWR≦5.0 is established has a maximum calculated value when the detour is disposed at such a position that $L/L_0$ is 0.25 or 0.75. This means that when the detour is disposed at such a position, it is possible to obtain an excellent antenna characteristic effective in a wide bandwidth in the case of the antenna conductor being formed in the shape shown in FIG. 2.

EXAMPLE 3

The high frequency wave glass antenna for an automobile according to the present invention was formed by disposing the antenna conductor 1 shown in FIG. 3 on a glass substrate as in Example 1, and values of VSWR were found by carrying out numerical calculations in accordance with electromagnetic field simulation under the same conditions as Example 1. The constants, such as the thickness of the glass substrate, and the dimensions of the respective parts of the planar antenna were as follows:

| | |
|---|---|
| $H_4$, W3 | 20 mm |
| W2 | 5 mm |
| Entire peripheral length of loop (containing detour elements) | 515 mm |

The unspecified constants were the same as Examples 1 and 2.

Figure 8:
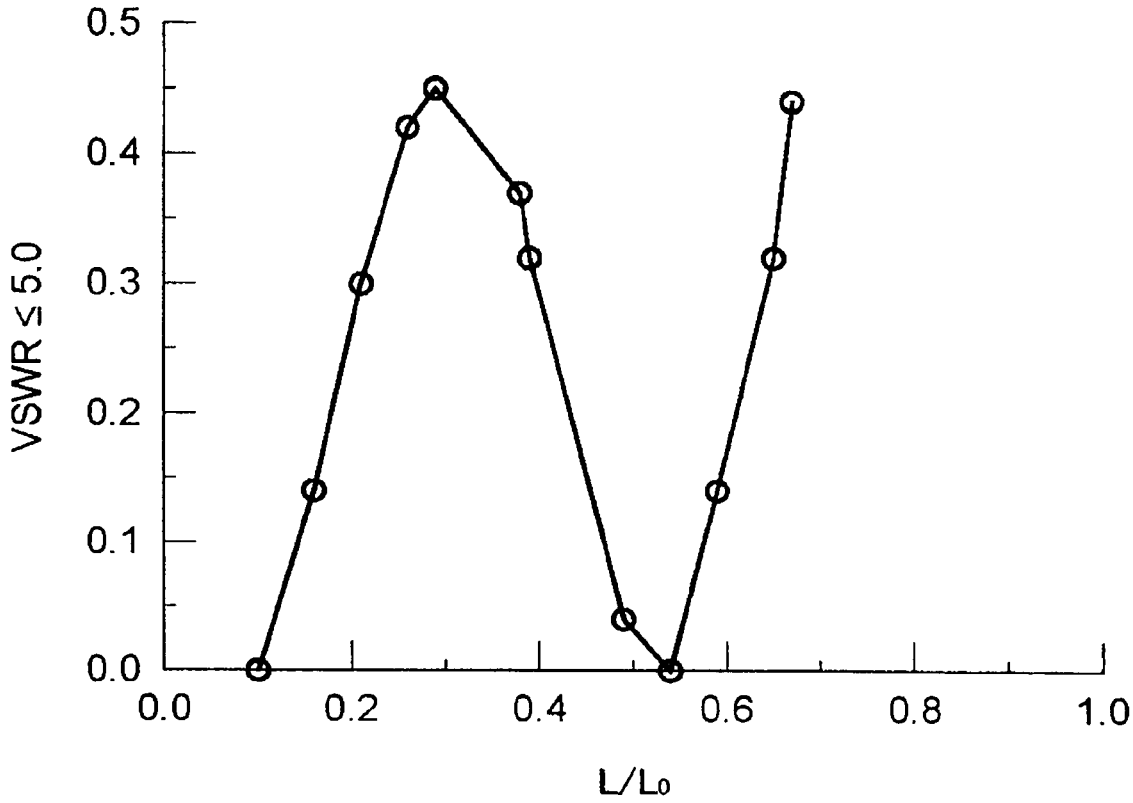
FIG. 8 is a characteristic graph of the antenna conductor shown in FIG. 3, which represents $L/L_0$ by the vertical axis and rates of VSWR≦5.0 by the horizontal axis.

FIG. 8 is a characteristic graph of the antenna conductor shown in FIG. 3, wherein the horizontal axis represents a value (=$L/L_0$) obtained by dividing the distance L from the center P1 of the discontinuity of the feeding portions 4*a* and 4*b* (as a point on the imaginary peripheral portion of the loop) to the center P2 of the detour 2 by the entire peripheral length $L_0$ (=2×(H21+W21)) of the loop that is obtained when it is assumed that no detour is disposed, and the vertical axis represents a rate that the formula of VSWR≦5.0 is established in a band range of 400 to 700 MHz.

As shown in FIG. 8, the rate that the formula of VSWR≦5.0 is established has a maximum calculated value when the detour is disposed at such a position that $L/L_0$ is 0.29 or in the vicinity of 0.67. This means that when the detour is disposed at such a position, it is possible to obtain an excellent antenna characteristic effective in a wide bandwidth in the case of the antenna conductor being formed in the shape shown in FIG. 3.

EXAMPLE 4

The high frequency wave glass antenna for an automobile according to the present invention was formed by disposing the antenna conductor 1 shown in FIG. 4 on the backlite of an actual automobile, and values of VSWR and antenna gain values were measured with the position of the detour being changed. FIG. 5 is a plan view showing this Example, wherein the antenna conductor shown in FIG. 4 was disposed on the backlite 12*a* of the automobile. The antenna conductor was disposed in an upper left area (seen from the car-interior side or a driver's seat in an automobile with a right-hand steering wheel) of the backlite 12*a* with a defogger and above the defogger, and the backlite 12*a* is inclined at an angle of 56 degrees with respect to a horizontal plane.

The antenna gain was measured at intervals of 1 degree by emitting a radio wave toward the automobile and rotating the automobile through 360 degrees. The radio wave was formed of a horizontally polarized wave, and its frequencies were changed at every 3 MHz in a frequency range of 470 to 770 MHz. The measurement was made in such a state that the angle of elevation between a position to emit the radio wave and the antenna conductor was set in a horizontal direction (in a direction having an angle of elevation of 0 degree in a case where the plane parallel with the ground is at an angle of elevation of 0 degree and the zenith direction is at an angle of elevation of 90 degrees). The antenna gain was represented by an average value, which was an average value of the average antenna gain measured by rotating the automobile through 360 degrees (at intervals of 1 is degree) in the entire frequency range of 470 to 770 MHz (at intervals of 3 MHz). The reference antenna was a half-wave dipole antenna. The constants, such as the thickness of the glass substrate, and the dimensions of the respective parts of the planar antenna were as follows:

d3, d4 and d5: 5 mm

The unspecified constants were the same as Example 3.

Figure 9:
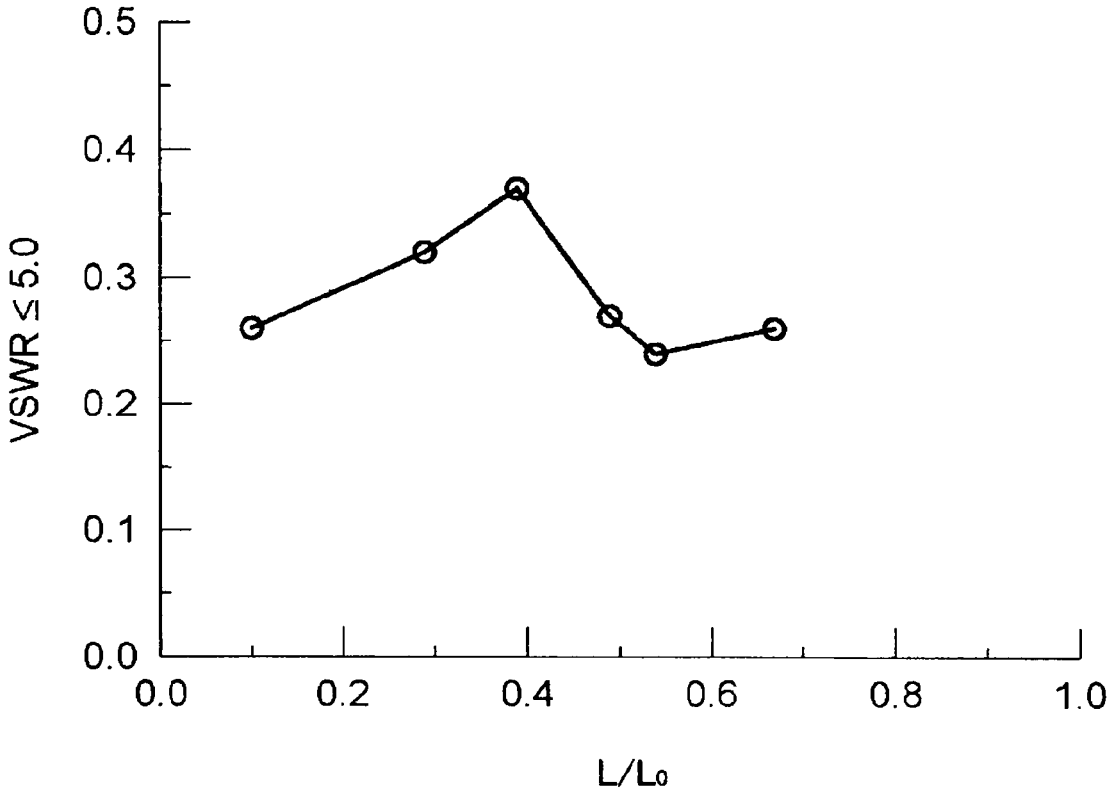
FIG. 9 is a characteristic graph of the antenna conductor shown in FIG. 4, which represents $L/L_0$ by the vertical axis and rates of VSWR≦=5.0 by the horizontal axis.
Figure 10:
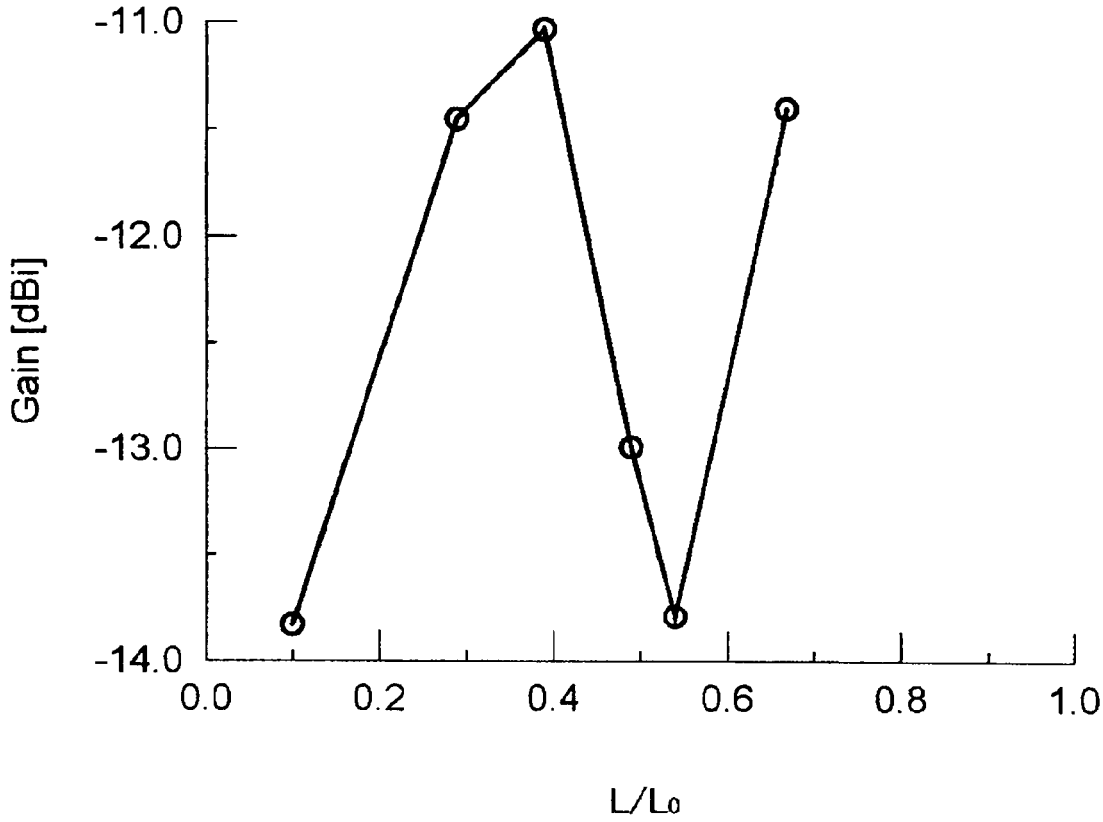
FIG. 10 is a gain characteristic graph on an actual automobile, which represents $L/L_0$ by the vertical axis and average values of an antenna gain.

FIG. 9 is a graph showing actual data of FIG. 8 measured under the above-mentioned conditions. FIG. 10 shows actual data of average values of the antenna gain measured under the above-mentioned conditions, wherein the horizontal axis represents $L/L_0$ as in FIG. 9.

As shown in FIG. 9, the rate that the formula of VSWR≦5.0 was established had a maximum value among the measured values when the detour was disposed at such a position that $L/L_0$ was 0.39. In other words, it is revealed that when the detour is disposed at such a position that $L/L_0$ ranges from 0.18 to 0.4, it is possible to obtain an excellent antenna characteristic effective in a wide broadband even in an actual vehicle. Also, as shown in FIG. 10, the antenna gain had a maximum value among the measured values when the detour was disposed at such a position that $L/L_0$ was 0.39. In other words, it is revealed that when the detour is disposed at a such position that $L/L_0$ ranges 0.18 to 0.4, it is possible to obtain an excellent antenna gain even in an actual vehicle.

EXAMPLE 5

Antenna conductors, which had different combinations of the presence and absence of the wide part 3 and the auxiliary conductor 7 shown in FIG. 4, were mounted to the backlite of an actual automobile as in Example 4, and the antenna gain was measured under the same conditions as Example 4. The relationship between the antenna gain and frequencies was measured for four patterns of the presence and absence of the wide part 3 and the auxiliary conductor 7 with respect to each of the antenna conductors mounted to the rear window glass sheet.

Figure 11:
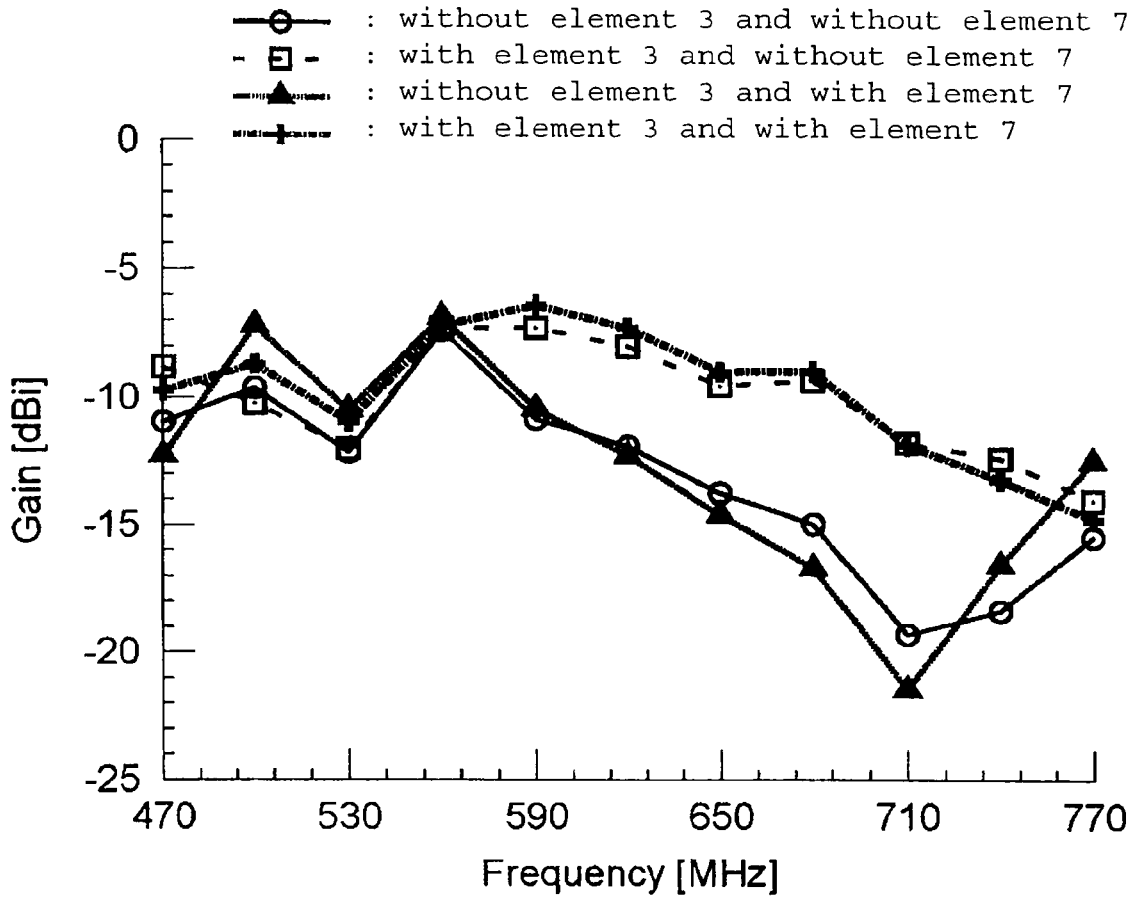
FIG. 11 is a graph showing the relationship between antenna gains and frequencies in a band of 470 to 770 MHz.

FIG. 11 is a graph showing the relationship between the antenna gains and the frequencies in a band range of 470 to 770 MHz. FIG. 11 reveals that when the antenna conductor 1 has the wide part 3 disposed in an upper side 1*f* thereof, it is possible to improve the antenna gain in a high frequency range, and that when the antenna conductor 1 has the auxiliary conductor 7 disposed in a lower side 1*e* thereof, it is possible to improve the antenna gain in a low frequency range.

In accordance with the glass antenna of the present invention described above, it is possible not only to reduce the size of the antenna but also to obtain an antenna characteristic effective in a wide bandwidth by the provision of the detour. In other words, it is possible to obtain a required antenna characteristic by adjusting the position of the detour in consideration of the results shown in FIG. 6 to FIG. 10. It is also possible to finely adjust the antenna characteristic by the addition of a wide part 3 or an auxiliary conductor 7.

It should be noted that the present invention is not limited to the above-described examples, and that modifications and substitute may be made in the above-described examples without departing from the spirit of the invention.

The entire disclosure of Japanese Patent Application No. 2008-093467 filed on Mar. 31, 2008 including specification, claims, drawings and summary are incorporated herein by reference in its entirety.

What is claimed is:

1. A high frequency wave glass antenna for an automobile, comprising:

an antenna conductor configured to be disposed in or on an automobile window glass sheet, the antenna conductor comprising:

a discontinuity formed by cutting a length of an original loop shape of the antenna conductor, feeding portions provided at both ends of the discontinuity or in the vicinity of said both ends of the discontinuity, and a detour provided in a portion of the original loop shape and comprising a single or a plurality of detour elements, the detour being the only detour of the original loop shape disposed in a position which satisfies that a ratio of a distance from a center of the discontinuity of the original loop shape to a center of the detour of the original loop shape, to a length of an inner peripheral edge of the original loop shape, ranges from 0.18 to 0.4.

2. The glass antenna according to claim 1, wherein the antenna conductor is configured so that the original loop shape is formed in a square shape, a rectangular shape, a substantially rectangular shape, a parallelogram shape having long sides and short sides, a substantially parallelogram shape having long sides and short sides, a trapezoidal shape or a substantially trapezoidal shape.

3. The glass antenna according to claim 2, wherein the antenna conductor is configured such that the detour is disposed in any one of four sides of the original loop shape, and that the discontinuity is disposed in the same side as the detour.

4. The glass antenna according to claim 2, wherein the long sides of the original loop shape totally have an inner peripheral length of $0.36 \cdot \lambda_g$ to $0.60 \cdot \lambda_g$, where:

a desired broadcasting frequency band has a wavelength of $\lambda_0$ in air, glass has a shortening coefficient of wavelength of k, k=0.64, and the formula of $\lambda_g = \lambda_0 \cdot k$ is satisfied.

5. The glass antenna according to claim 1, wherein the antenna conductor is configured so that the original loop shape is formed in a rectangular shape, that the detour is disposed at or in the vicinity of one end of a longer side of the rectangular shape, and that the feeding portions are disposed at or in the vicinity of the other end of the long side.

6. The glass antenna according to claim 5, wherein the antenna conductor is configured so that the original loop shape is a rectangular shape, and that at least 70% of an entire length of at least one of the longer sides of the rectangular shape has a width of 2 to 20 mm.

7. The glass antenna according to claim 6, wherein the antenna conductor is configured so that the original loop shape is formed in a rectangular shape, that at least one of the longer sides of the rectangular shape has at least one linear auxiliary conductor in parallel or in substantially parallel therewith with a distance of 2 to 20 mm therefrom, and that the auxiliary conductor provided inside the original loop shape.

8. The glass antenna according to claim 7, wherein the detour elements are formed in an angulated U-character shape, a substantially angulated U-character shape, a U-character shape, a substantially U-character shape, a V-character shape, a substantially V-character shape, a semicircular shape or a substantially semicircular shape.

9. The glass antenna of claim 7, wherein the detour is disposed in a portion of the longer side, and said auxiliary conductor is not applied to said portion of the at least one longer side with the detour.

10. The glass antenna of claim 6, wherein the detour is disposed in a portion of the longer side, and said width is not applied to said portion of the at least one longer side with the detour.

11. The glass antenna according to claim 5, wherein the antenna conductor is configured so that the original loop shape is formed in a rectangular shape, that at least one of the longer sides of the rectangular shape has at least one linear auxiliary conductor in parallel or in substantially parallel therewith with a distance of 2 to 20 mm therefrom, and that the auxiliary conductor provided inside the original loop shape.

12. The glass antenna of claim 11, wherein the detour is disposed in a portion of the longer side, and said auxiliary conductor is not applied to said portion of the at least one longer side with the detour.

13. The glass antenna according to claim 5, wherein the detour elements are formed in an angulated U-character shape, a substantially angulated U-character shape, a U-character shape, a substantially U-character shape, a V-character shape, a substantially V-character shape, a semicircular shape or a substantially semicircular shape.

14. The glass antenna according to claim 1, wherein the antenna conductor is configured so that the original loop shape is a rectangular shape, and that at least 70% of an entire length of at least one of the longer sides of the rectangular shape has a width of 2 to 20 mm.

15. The glass antenna according to claim 14, wherein the detour is disposed in a portion of the longer side, and said width is not applied to said portion of the at least one longer side with the detour.

16. The glass antenna according to claim 1, wherein the antenna conductor is configured so that the original loop shape is formed in a rectangular shape, that at least one of the longer sides of the rectangular shape has at least one linear auxiliary conductor in parallel or in substantially parallel therewith with a distance of 2 to 20 mm therefrom, and that the auxiliary conductor provided inside the original loop shape.

17. The glass antenna of claim 16, wherein the detour is disposed in a portion of the longer side, and said auxiliary conductor is not applied to said portion of the at least one longer side with the detour.

18. The glass antenna according to claim 1, wherein the antenna conductor containing the detour and the discontinuity of the original loop shape has an inner peripheral length of $0.79\lambda_g$ to $2.50\lambda_g$, where:

a center frequency of a desired broadcasting frequency band has a wavelength of $\lambda_0$ in air, glass has a shortening coefficient of wavelength of k, and $\lambda_g = \lambda_0 \cdot k$ is satisfied.

19. The glass antenna according to claim 1, wherein the antenna conductor has an inner peripheral edge forming in a shape having a maximum vertical width H and a maximum transverse width W, and wherein the maximum vertical width and the maximum transverse width have a relationship satisfying the formula (W/H=1 to 9).

20. The glass antenna according to claim 1, wherein the detour elements are formed in an angulated U-character shape, a substantially angulated U-character shape, a U-character shape, a substantially U-character shape, a V-character shape, a substantially V-character shape, a semicircular shape or a substantially semicircular shape.

21. The glass antenna according to claim 20, wherein the detour elements have a maximum width of 2.5 to 7.5 mm in a direction along the original loop shape, the detour elements have a maximum distance of 11 to 33 mm remote from the original loop shape, the detour is formed of a plurality of detour elements, and the detour is disposed to have a distance between adjacent detour elements of 2.5 to 7.5 mm.

22. The glass antenna according to claim 1, wherein the detour is formed in such a shape to have an effect similar to a reactance circuit.

23. The glass antenna according to claim 1, the antenna conductor is configured to be disposed in an upper area of the automobile window glass sheet so that a distance between an upper edge of an aperture area for the automobile window glass sheet and an entire upper side of the antenna conductor has an average value of $0.032 \cdot \lambda_g$ or more;

a portion of the original loop shape serving the upper side has a maximum length of $0.36\lambda_g$ to $0.60\lambda_g$ on the outer peripheral edge; and a shortest distance between the upper edge and a portion of the outer peripheral edge of the antenna conductor farthest from the upper edge is 200 mm or less, where:

a center frequency of a desired broadcasting frequency band has a wavelength of $\lambda_0$ in air, glass has a shortening coefficient of wavelength of k, k=0.64, and $\lambda_g = \lambda_0 \cdot k$ is satisfied.

24. The glass antenna according to claim 1, wherein:

the automobile window glass sheet includes a defogger formed of a plurality of heating elements and a plurality of bus-bars for energizing the heating elements, the heating elements extending in a horizontal direction, in a substantially horizontal direction or in a direction along an upper edge or a lower edge of the automobile window glass sheet;

the antenna conductor is disposed in an upper area of the automobile window glass sheet so that a distance between a heating element of the defogger at a highest position and an entire lower side of the antenna conductor confronting said heating element has an average value of $0.0097 \cdot \lambda_0$ or more; and a portion of the original loop shape serving the lower side has a maximum length of $0.36\lambda_g$ to $0.60\lambda_g$ on the outer peripheral edge, where:

a center frequency of a desired broadcasting frequency band has a wavelength of $\lambda_0$ in air, glass has a shortening coefficient of wavelength of k, k=0.64, and the formula of $\lambda_g = \lambda_0 \cdot k$ is satisfied.

25. The glass antenna according to claim 1, wherein the antenna conductor is disposed in or on a plastic film, and the antenna conductor is mounted to the automobile window glass sheet along with the plastic film.

26. A window glass sheet for an automobile, including the antenna conductor defined in claim 1.

27. A high frequency wave glass antenna for an automobile, comprising:

an antenna conductor configured to be disposed in or on an automobile window glass sheet, the antenna conductor comprising:

a discontinuity formed by cutting a length of an original loop shape of the antenna conductor, feeding portions provided at both ends of the discontinuity or in the vicinity of said both ends of the discontinuity, and a detour provided in a portion of the original loop shape and comprising a single or a plurality of detour elements, the detour being the only detour of the original loop shape and being disposed in a position which satisfies that a ratio of a distance from a center of the discontinuity of the original loop shape to a center of the detour of the original loop shape, to a length of an outer peripheral edge of the original loop shape, ranges from 0.18 to 0.4.

* * * * *